United States Patent [19]

Cecil

[11] Patent Number: 4,526,069

[45] Date of Patent: Jul. 2, 1985

[54] ADAPTER FOR WRENCH SOCKETS

[75] Inventor: Richard L. Cecil, Dayton, Ohio

[73] Assignee: Easco Corporation, Baltimore, Md.

[21] Appl. No.: 550,561

[22] Filed: Nov. 10, 1983

[51] Int. Cl.[3] ..... B25B 13/00

[52] U.S. Cl. ..... 81/177.85; 81/180.1

[58] Field of Search ..... 81/177 R, 177 G, 180 R, 81/177 A, 177 B, 58.1, 60-63.2, 121; 29/239

[56] References Cited

U.S. PATENT DOCUMENTS

| | | | |
|---|---|---|---|
| 2,672,066 | 3/1954 | Sandrock et al. | 81/58.1 |
| 2,982,160 | 5/1961 | Little | 81/63 |
| 3,107,419 | 10/1963 | Sandifer | 29/239 |
| 3,138,984 | 6/1964 | Penner | 81/121 R |
| 3,269,228 | 8/1966 | Mack | 81/177 A |
| 3,283,621 | 11/1966 | Faso | 81/58.1 |
| 3,881,376 | 5/1975 | Wright | 81/177 G |

*Primary Examiner*—James L. Jones, Jr.
*Attorney, Agent, or Firm*—Leonard Bloom

[57] ABSTRACT

An adapter for a conventional wrench socket facilitates the use of an open-end or box wrench in confined and inaccessible areas where a conventional ratchet wrench cannot be used. The adapter includes a downwardly-facing closed internal slot for facilitating a convenient removal of the adapter from the wrench socket.

4 Claims, 6 Drawing Figures

ADAPTER FOR WRENCH SOCKETS

FIELD OF THE INVENTION

The present invention relates to an adapter for a cylindrical wrench socket of the type normally driven by a ratchet wrench, and more particularly, to an adapter which enables the socket to be driven by an open-end wrench, box wrench or the like in confined or inaccessible areas where the ratchet wrench cannot be used.

BACKGROUND OF THE INVENTION

A ratchet wrench set or kit is widely used by automobile mechanics, craftsman, homewowners, do-it-yourselfers and the like. The kit consists of a conventional ratchet wrench together with a number of sockets, drive extensions and other adapters. The ratchet has a standard square-drive shank or tang (such as $\frac{1}{4}$- $\frac{3}{8}$- $\frac{1}{2}$ inch) for cooperation with a complementary input drive opening or recess in the sockets. The opposite end of each socket is formed with an output drive recess or socket (usually hexagonal) to drive a wide range of nuts or bolt heads.

In certain confined or inaccessible applications, however, it is not possible to use the ratchet wrench, nor is it possible to use a conventional open-end wrench or box wrench. These applications may be found, for example, in automotive repair where special tools are sometimes required. Although pliers or similar grips may sometimes be used to engage the nut, the pliers will usually slip. Besides ruining the nut or bolt head by rounding off its corners, this slipping may cause injury to the user's hand.

The prior art has generally taught the use of a wide variety of adapters. For example, U.S. Pat. No. 2,210,742 issued in 1940 discloses an elongated wrench adapter similar to an extension and consisting of an upper hexagonal driving head driven by an offset handle, and a lower hexagonal driving head received within a socket. The upper hexagonal head extends inwardly of the lower hexagonal head (in a radial direction) and is separated therefrom by an intermediate cylindrical pilot or race section. Moreover, in U.S. Pat. No. 2,991,678 issued in 1961, the socket itself is formed with a hexagonal head for accommodating a flat open-end wrench. Furthermore, an adapter having a hexagonal head formed integrally with a square drive shank or stud is well known in the prior art, as for example, FIG. 6 of U.S. Pat. No. 3,838,614.

The prior art is further exemplified by U.S. Pat. Nos. 1,489,696; 1,775,402; 3,269,228; and 3,875,829; and by the following U.S. Pats.: Des. 199,091; Des. 245,395; Des. 255,979; and Des. 261,608. A variety of hexagonal-to-hexagonal adapters (both male-to-male and male-to-female) have been utilized in commercial practices.

However, none of these prior art disclosures and commercial practices show a hexagonal-to-square wrench adapter for facilitating use in a confined area, where a conventional ratchet wrench cannot be used, and wherein the adapter includes a convenient means for subsequently removing the adapter from the wrench socket.

SUMMARY OF THE INVENTION

Accordingly, it is an object of the present invention to alleviate the disadvantages and deficiencies of the prior art by providing an adapter to readily accommodate the driving of a wrench socket in confined or inaccessible areas, where use of a conventional ratchet wrench would be precluded, and wherein means are provided for facilitating an easy removal of the adapter from the wrench socket.

The preferred adapter includes a drive shank having a polygonal cross-section (preferably square) complementary to, and adapted to be received within, the input drive opening of the socket. The adapter further includes a top portion formed integrally with the drive shank at one end thereof and extending laterally therefrom. The plan outline of the top portion of the adapter has a polygonal configuration (preferably hexagonal) for accommodating an open-end wrench or the like. Preferably, the top portion of the adapter is relatively narrow compared to the drive shank, which is elongated.

In accordance with the teachings of the present invention, the adapter is provided with means to accommodate the insertion of an implement between the adapter and the socket, thereby to facilitate a convenient removal of the adapter from the socket.

These and other objects of the present invention will become apparent from a reading of the following specification taken in conjunction with the enclosed drawings.

GENERAL DESCRIPTION OF THE PREFERRED EMBODIMENT

Figure 1:
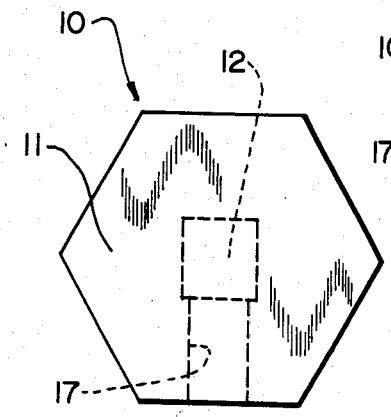
FIG. 1 is a top plan view of the adapter of the present invention.
Figure 2:
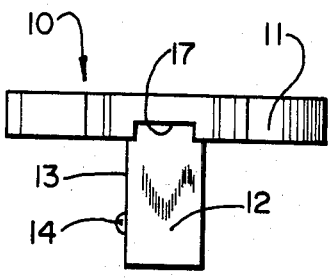
FIG. 2 is a front elevation thereof.

With reference to FIGS. 1 and 2, there is illustrated a preferred form of the wrench socket adapter 10 of the present invention. The adapter 10 may be made of a suitable material, such as a carbon or alloy steel, and may be formed and hardened using conventional heat treating techniques. The adapter 10 comprises a main body or top portion 11 formed integrally with an elongated drive shank 12 at one end thereof and extending laterally therefrom, the drive shank being positioned centrally of the top portion of the adapter. The drive shank will be standard for each adapter in the kit, being substantially identical to the drive shank or tang of a conventional ratchet wrench. The top portion of the adapter is relatively narrow or thin in comparison to the drive shank (in the direction taken along the axis of the shank) and the thickness of the top portion of the adapter can be varied if desired. The drive shank has a polygonal cross-section which is preferably square (as shown) and is provided with four faces. One of the faces (as at 13) may be provided with a ball detent 14, which is similar to the usual detent on the drive tang of the ratchet wrench. The top portion of the adapter extends laterally of the drive shank and has a polygonal plan outline which is preferably a hexagon (as shown).

Figure 3:
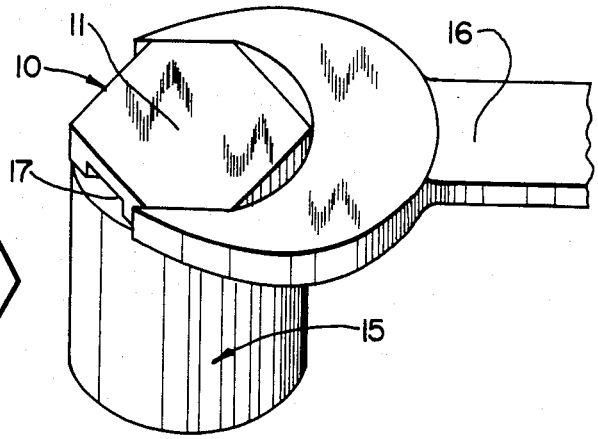
FIG. 3 is a perspective view, showing the adapter mounted on a socket, and further showing the use of an open-end wrench.

The adapter 10 may be received within a conventional wrench socket 15, as shown in FIG. 3, to enable the socket to be driven by an open-end wrench 16. In FIG. 3, the corners of the hexagonal plan outline of the top portion of the adapter are substantially coterminous with the circumference of the circular cross-section of the cylindrical socket. If desired, one adapter may be made for each socket in the ratchet wrench kit; however, a set of three adapters will suffice to accommodate all of the sockets in the kit (whether for inch or metric sizes). Moreover, in lieu of the open-end wrench 16, a box wrench or other suitable implement may be used.

Figure 4:
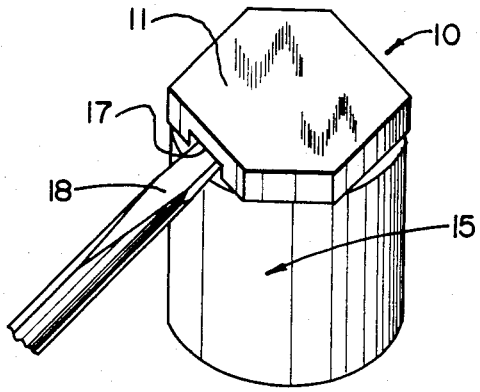
FIG. 4 is a further perspective of the adapter on the socket, showing the use of a screwdriver blade received within a slot on the adapter, the blade being wedged between the adapter and the socket for facilitating a convenient removal of the adapter from the socket in accordance with the teachings of the present invention.

The improvement of the present invention includes means to facilitate a convenient removal of the adapter 10 from the socket 15. In a preferred embodiment, this means comprises an open slot 17 formed in the underside of the top portion of the adapter. Preferably, the slot 17 extends to the drive shank of the adapter as shown in FIG. 1. This slot 17 enables the blade 18 of a screwdriver (or other suitable implement) to be inserted into the slot, as shown in FIG. 4, and wedged between the adapter and the socket to lift the adapter away from the socket. This arrangement provides a distinct mechanical advantage in case the adapter becomes stuck or "frozen" on the socket and hence difficult to remove by hand. In lieu of the slot, however, other suitable means may be provided to accommodate the wedging and lifting action to facilitate the convenient removal of the adapter from the socket.

Figure 5:
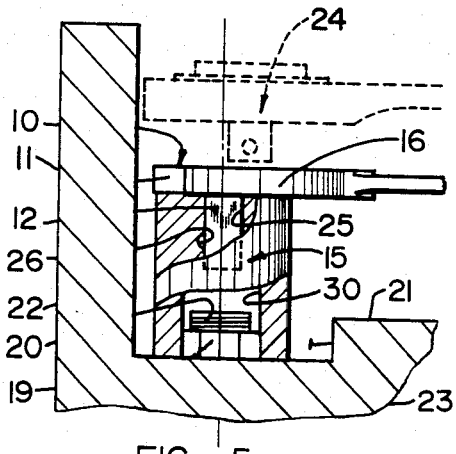
FIG. 5 is a side elevation of a typical confined application, showing the use of the adapter to drive a socket by means of an open-end wrench, the broken lines illustrating a conventional ratchet wrench (the use of which is precluded in this confined application).

One application of the adapter 10 of the present invention is shown in FIG. 5. There, a nut 19 is seated on the shank of a bolt 20 within a dwell or recess 21 defined by walls 22 and 23. The socket 15 is positioned on the nut 19 in the usual manner. However, there is not enough clearance to enable a conventional ratchet wrench 24 (shown in broken lines) to drive the socket. This problem is solved by the adapter 10, which fits directly on top of the socket. The drive shank 12 of the adapter is received within the complementary square cross-sectioned input drive opening 25 of the socket, being retained therein by means of the detent 14 which is received within an internal annular groove or pocket 26 formed within the socket. The open-end wrench 16 may fit within this confined space (inaccessible to the conventional ratchet wrench) to drive the socket to tighten (or remove) the nut.

Figure 6:
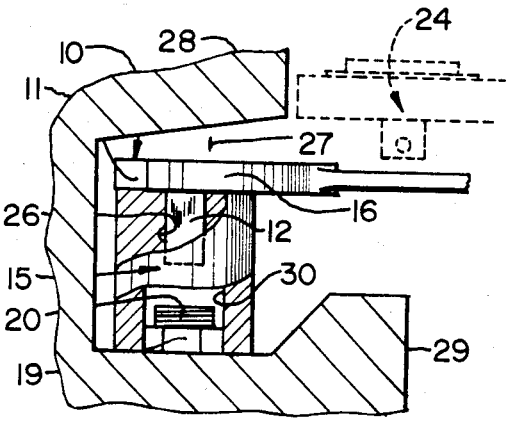
FIG. 6 is a side elevation of a further typical confined application, showing the use of the adapter of the present invention.

Another typical application of the adapter is shown in FIG. 6. There the nut is positioned within a recess 27 confined by vertically-spaced walls 28 and 29. As in FIG. 5, the socket 15 is preferably provided with a hexagonal output drive socket 30 to accommodate the nut.

Accordingly, it will be appreciated that the adapter of the present invention is a convenient item or accessory for the tool kit of the professional mechanic, homeowner or do-it-yourselfer. Moreover, a set of three adapters is sufficient for the normal ratchet wrench kit, and the adapters may be manufactured easily and economically for widespread distribution and usage out in the field.

Obviously, many modifications may be made without departing from the basic spirit of the present invention. Accordingly, it will be appreciated by those skilled in the art that within the scope of the appended claims, the invention may be practiced other than has been specifically described herein.

I claim:

1. In an adapter for a cylindrical wrench socket, wherein the socket is normally driven by a conventional ratchet wrench or the like, wherein the socket includes an input drive opening having a polygonal cross-section, and wherein the adapter comprises a drive shank having a polygonal cross-section complementary to the input drive opening of the socket, whereby the adapter may be inserted within the socket for driving the same, and a top portion formed integrally with the drive shank at one end thereof and extending laterally therefrom, the top portion having a polygonal configuration, whereby an open-end wrench or the like may be received on the top portion of the adapter for driving the socket whenever the socket would be inaccessible to a ratchet wrench: the improvement which comprises means on the adapter for facilitating a convenient removal of the adapter from the socket, wherein said means comprises the top portion having a a downwardly-facing closed internal slot formed therein, the slot having a transverse width which is substantially less than the length of the adjacent respective side of the polygonal top portion of the socket, whereby a screw driver blade or the like may be inserted into the slot and wedged between the adapter and the top of the socket.

2. The improvement of claim 1, wherein the slot extends substantially to the drive shank and runs between the parallel side edges of the drive shank and the polygonal top portion of the adapter, respectively.

3. The improvement of claim 2, wherein the top portion of the adapter has outer dimensions which are substantially coterminous with the circumference of the circular cross-section of the cylindrical socket, and wherein the top portion of the adapter is substantially thinner than the length of the drive shank.

4. The improvement of claim 1, wherein the width of the slot is substantially the same as the width of the drive shank.

* * * * *